US005727980A

United States Patent [19]

Stipa

[11] Patent Number: 5,727,980

[45] Date of Patent: Mar. 17, 1998

[54] DECORATIVE WIND DEVICE

[76] Inventor: Guido Stipa, 11 Utah Trail, Medford, N.J. 08055

[21] Appl. No.: 655,039

[22] Filed: May 29, 1996

[51] Int. Cl.[6] ..... A63H 33/40

[52] U.S. Cl. ..... 446/217; 416/132 A; 416/240; D10/59; D21/93

[58] Field of Search ..... 446/217, 218, 446/176; 40/479, 440, 480; 416/11, 176, 240, 142 R, 132 A, 132 B; D10/59; D11/141; D21/93

[56] References Cited

U.S. PATENT DOCUMENTS

| | | | |
|---|---|---|---|
| D. 278,131 | 3/1985 | Felix | 416/132 B X |
| 1,669,748 | 5/1928 | Greger | 446/218 |
| 1,852,383 | 4/1932 | Walkner | 40/479 |
| 3,374,763 | 3/1968 | Browning | 446/218 X |
| 3,747,263 | 7/1973 | Grossberg | 446/217 |
| 4,850,798 | 7/1989 | Bailey | 416/176 X |

*Primary Examiner*—Mickey Yu
*Attorney, Agent, or Firm*—Donald C. Simpson; Mark D. Simpson

[57] ABSTRACT

A decorative wind device that rotates about a central point. The axis of rotation can vary depending upon several factors including the direction of the wind and the speed or intensity of the wind. The device includes multiple strips of flexible, lightweight material that are connected at a common point at one end (the top of the device); the bottom ends of the strips are not connected at a common point but are, instead, linked to multiple concentric connecting rings made of, for example, sections of connecting material such as wire. The strips are positioned at an angle that places them in an optimum position to be blown by the wind. The resulting device, when hung outdoors or in any other area that has a source of wind, requires very little wind current to cause it to rotate. Further, because of the lightweight, flexible material used for the strips, the strips bend when the wind blows upon them, deforming the device into a pleasing, rounded shape approaching the shape of a sphere. Since there is no rigid central shaft, there is nothing to keep the top and bottom of the strips from being urged towards each other during rotation.

4 Claims, 4 Drawing Sheets

DECORATIVE WIND DEVICE

FIELD OF THE INVENTION

This invention relates to decorative wind devices which are made of flexible material and which rotate in a wind current, resulting in a pleasing effect for a viewer of the device.

BACKGROUND OF THE INVENTION

Many wind operated devices are known that comprise fins, arms, or other projections, coupled to an axis, that are designed to catch a stream of wind current and rotate about the axis. Such devices can perform work, such as a windmill, or can provide amusement for viewers of the device, such as a pinwheel or rotating wind sock.

The classic pinwheel configuration, an example of which is shown in U.S. Pat. No. 2,510,336, comprises single piece of flexible material, such as plastic, that is cut so that can be placed upon a pin attached to a stick. Elongate portions are formed by cutting slices in the single sheet, and the ends of the elongate portions are connected at a central point at the other end of the pin. So formed, the pinwheel shape is achieved and wind blowing towards the pinwheel causes it to rotate. The pinwheel remains substantially in the classic pinwheel shape regardless of the speed or intensity of the wind current.

U.S. Pat. No. 3,680,252 teaches a wind powered spinning toy comprising two horizontally disposed, vertically spaced parallel plates connected by a two curved body members and mounted on a vertically disposed stick that provides an axis of rotation. Decorative "arms" and "legs" are attached so that the device resembles a person. Wind current hitting the body members causes the plates to rotate about the axis of the stick, causing a desirable effect for one viewing the device.

U.S. Pat. No. 3,747,263 to Grossberg teaches a pinwheel comprising a plurality of flexible blade members rotatably journaled on a shaft (the "pin") and constrained relative to one another in a curved manner. All of the top ends of the flexible blade members are connected to each other near the top of the shaft at a common point, and all of the bottom ends of the flexible blade members are connected to each other near the bottom of the shaft at a common point. The device rotates about the axis of the shaft when subjected to wind current; the shaft keeps the device from deforming to a shape other than a sphere.

SUMMARY OF THE INVENTION

The present invention is a decorative wind device that rotates about a central point. The axis of rotation can vary depending upon several factors including the direction of the wind and the speed or intensity of the wind. The device includes a plurality of flexible blade members made of, for example, strips of flexible, lightweight material that are connected at a common point at one end (the top of the device); the bottom ends of the strips are not connected at a common point but are, instead, linked to concentric, circumferential connecting means comprising, for example, sections of connecting material such as wire. The strips are positioned at an angle that places them in an optimum position to be blown by the wind. The resulting device, when hung outdoors or in any other area that has a source of wind, requires very little wind current to cause it to rotate. Further, because of the lightweight, flexible material used for the strips, the strips bend when the wind blows upon them, deforming the device into a pleasing, rounded shape approaching the shape of a sphere. Since there is no rigid central shaft, there is nothing to keep the top and bottom of the strips from being urged towards each other during rotation.

DESCRIPTION OF THE PREFERRED EMBODIMENTS

Figure 1:
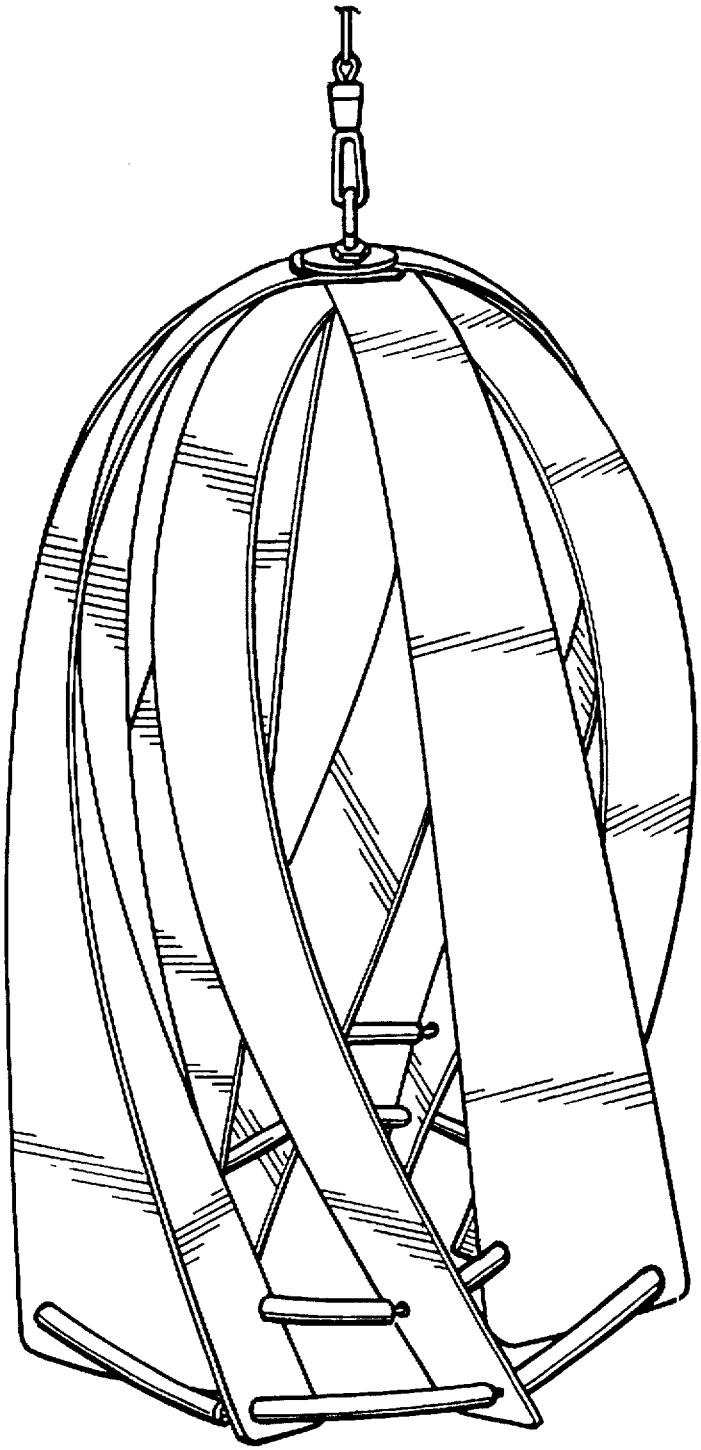
FIG. 1 shows a perspective view of the fully assembled device of the present invention.
Figure 2:
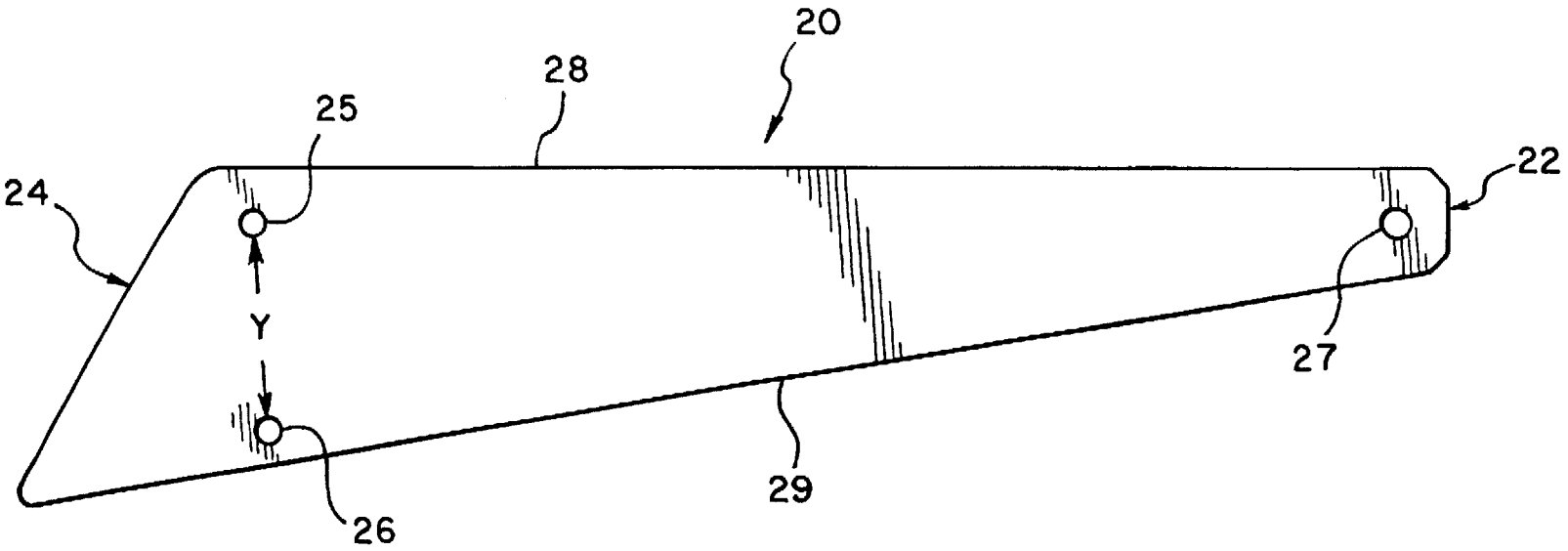
FIG. 2 is a side view of one of the flexible blades of the present invention.

FIG. 1 is a perspective view showing the fully assembled wind device 10 as it would be hung to catch wind currents. To fully understand the construction of the invention, reference is made to FIGS. 2–5, which shows one configuration of the component parts of the present invention as they are formed before assembly. FIG. 2 shows one of the flexible strips 20 of the present invention. As shown, the flexible strip 20 comprises a generally triangular shaped "blade"; it is not actually triangular because the narrow top end 22 does not come to a point, as shown in FIG. 2. Further, the blade does not have to be triangular; the particular shape shown was selected simply because it results in a pleasing-looking finished product. The flexible strip 20 is made of any flexible material that is readily deformable but that will return to a planar shape when at rest. The applicant has found that plastic sheeting is suitable for use in making the flexible strips 20.

Outer ring hole 25, inner ring hole 26, and junction ring hole 27 are drilled through each flexible strip 20 for reasons to be explained below. Outer ring hole 25 is positioned near the outer edge 28 of flexible strip 20, and inner ring hole 21 is positioned near the inner edge of flexible strip 20. Both outer ring hole 25 and inner ring hole 26 are positioned towards the wider, bottom end 22 of flexible strip 20. Junction ring hole 27 is positioned near the narrower, top end 22 of flexible strip 20. The applicant has found that using a quantity of eight flexible strips 20 so configured results in a wind device that operates very well.

Figure 3:
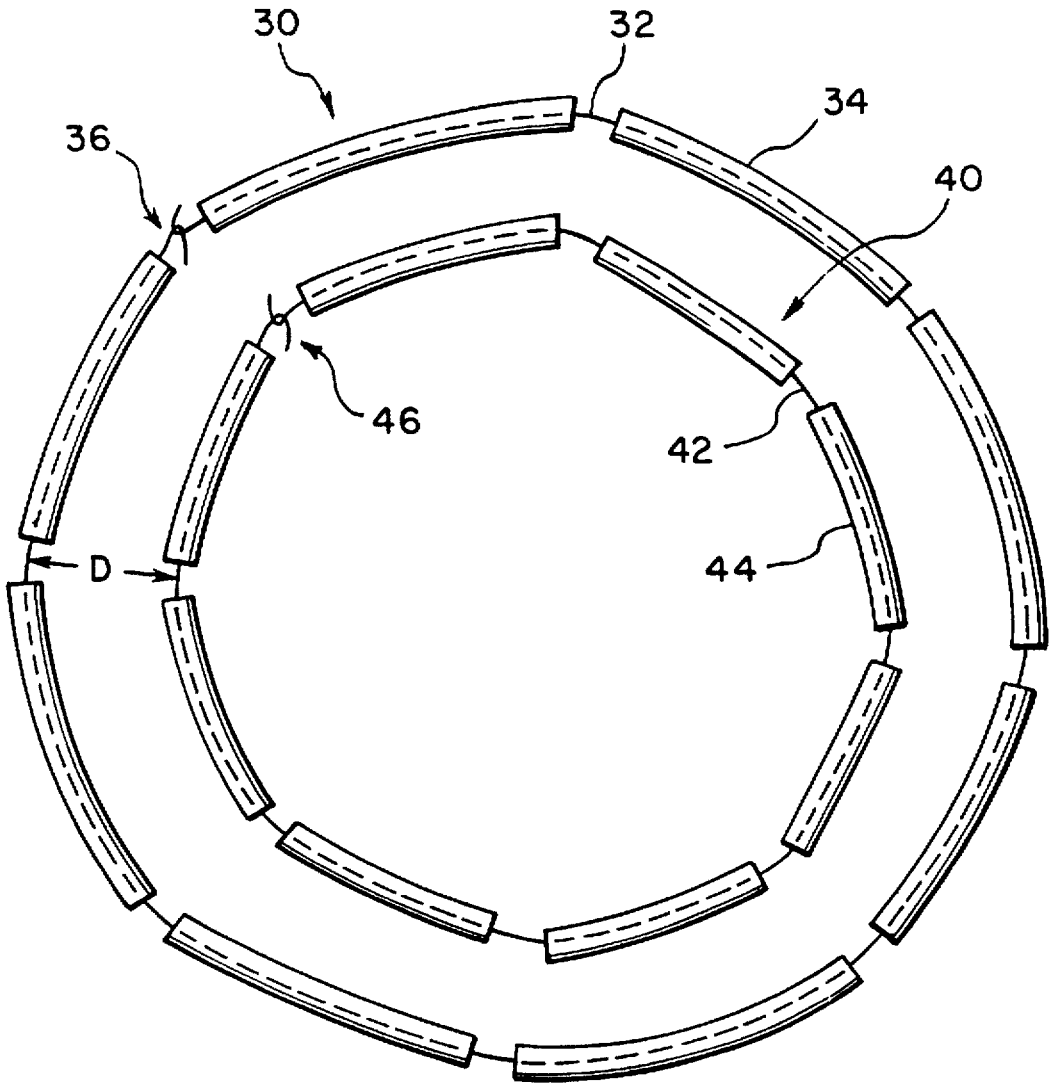
FIG. 3 is a top view of the outer and inner rings of the present invention, juxtaposed in their approximate positions relative to each other in a fully assembled device.

FIG. 3 shows the two ring structures 30 and 40 that are used in connection with the flexible blades 20. Each ring structure 30 and 40 comprises a semi-rigid material, such as X-gauge wire, that is formable into a ring (32 and 42), and divider sections (34 and 44) of a number equal to the number of flexible strips 20 being used. The size of outer ring 30 is chosen such that when the flexible blades 20 are installed on the outer ring 30, the device takes on the general shape of a bell. A generally larger outer ring 30 will result in a more flared bell "mouth" while a generally smaller outer ring 30 will result in a straighter, or even tapered, bell mouth. The size of the inner ring 40 is selected so that the distance D between the outer ring 32 and the inner ring 42 is equal to the distance Y between the outer ring hole 25 and the inner ring hole 26.

Figure 4:
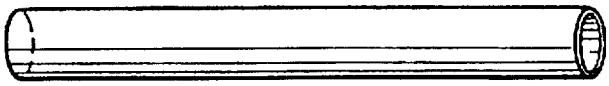
FIG. 4 is a detailed perspective view of one of the divider sections of the present invention.

The divider sections 34 for outer ring 30 are of equal size, the specific size being selected so that, when they are placed on the outer ring 32, there is a slight separation between each divider section 34. FIG. 4 shows the typical configuration of a divider section formed in this manner. The size of the separation between each divider section is chosen to be slightly greater than the thickness of the material used for the flexible blades 20 so that the flexible blades 20 can fit between them; ideally, a little extra room should be included to allow a slight lateral movement of the divider sections 34 along the ring 32. Likewise, the divider sections 44 for inner ring 42 are of equal size, although they will be smaller than the divider sections 34 because the circumference of the inner ring 42 is smaller than the circumference of the outer ring 32 The applicant has found that flexible plastic tubing is well suited for the divider sections. The tubing is easily cuttable into the desired sized sections and can be inserted onto the rings quite easily.

For ease of assembly, the semi-rigid ring material is first cut to the desired lengths (one length for the outer ring structure 30 and a smaller length for the inner ring structure 40), with an additional amount added to allow the formation of hooks (36 and 46) on each end. The hooks (36 and 46) are used to secure the ring material in the ring shape once the various other pieces are threaded thereon.

Figure 5:
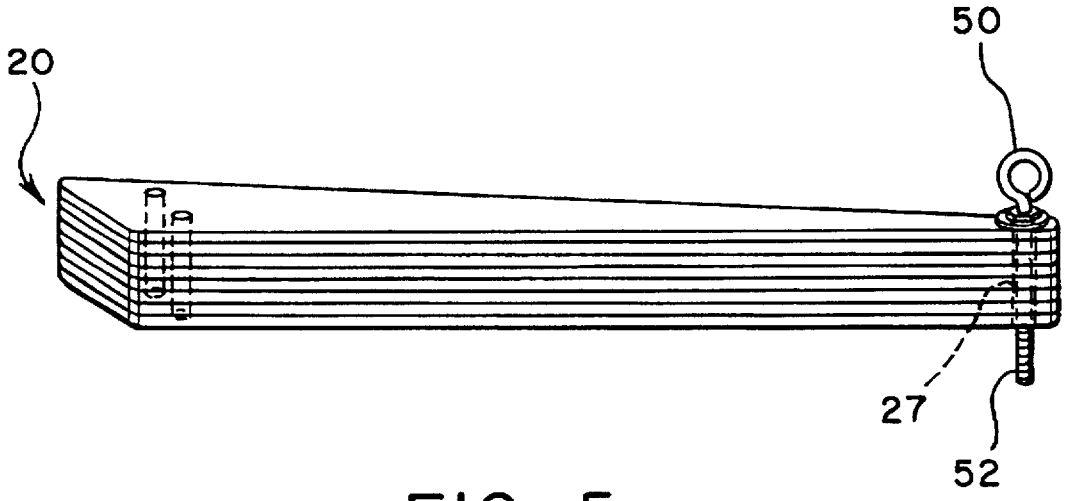
FIG. 5 is a perspective view of the flexible blades of the present invention as they are prepared for final assembly.

To assemble the device, all of the flexible blades 20 are placed on top of each other oriented in the same direction, as shown in FIG. 5. An eyehook 50 having a threaded end 52 is used to secure the narrow top ends 22 of each flexible blade 20 together as shown. The applicant has found that threading a nut onto the eye hook, followed by a 1-inch diameter washer (neither shown), and then inserting the eyehook into the junction hole 27, followed by a second 1-inch diameter washer and a second nut (neither shown), is a sound method of securing together the flexible blades 20. When secured in this manner, the blades can be "fanned out" with the eyehook 50 at the center.

With the flexible blades 20 secured at the junction hole 27 and the blades fanned out, the process of attaching the bottom of the blades to the inner ring structure 40 and outer ring structure 30 is performed. Beginning with the inner ring structure 40, one end of ring 42 is bent to form hook 46 as shown and then a first divider section 44 is slipped onto the ring 42 at the end that is not hooked. The first divider section is moved along the ring 42 until it reaches the hook 46 at the end. The hook 46 prevents the divider section from slipping off of the ring 42. Next, the unhooked end of ring 42 is slipped through the inner ring hole 26 of the first of the flexible blades 20. A second divider section 44 is slipped over the ring 42 and then the ring 42 is inserted through the inner ring hole 26 of the second of the flexible blades 20. This process is repeated until all of the divider sections have been used up and all of the blades are inserted on the ring. The unhooked end of the ring is then bent to form a second hook 46, and the two hooks are hooked together to form the completed circle.

This same process is repeated for the outer ring 30. The resulting configuration is a substantially bell-shaped device with fins angled to catch the wind current as shown in FIG. 1. To enable the device to rotate freely in the wind, a swivel connector, such as that used for attaching fishing lures to fishing lines or kites to kite string is connected to eye hook 50, and the device is hung by the swivel connector near a wind source.

The many features and advantages of the invention are apparent from the detailed specification and thus it is intended by the appended claims to cover all such features and advantages of the invention which fall within the true spirit and scope thereof. Further, since numerous modifications and changes will readily occur to those skilled in the art, it is not desired to limit the invention to the exact construction and operation illustrated and described and, accordingly, all suitable modifications and equivalents may be resorted to, falling within the scope of the invention. For example, the shape of the flexible blades does not have to be precisely as shown in FIG. 2; the applicant has used several different shapes for the blades for decorative purposes and the device operates in substantially the same manner as when the pictured blades are used. Further, the dividing members do not need to be tube shaped but can, instead, be of any shape as long as they serve the purpose of keeping the flexible blades spaced apart from each other while allowing some movement of the blades. In addition, two of said devices could be interconnected, one inverted upside down, such that the top device rotates in one direction while the bottom device rotates in the other direction. Another configuration could have the top end of the flexible blades connected at a common point and the bottom ends of the flexible blades connected at a common point, with the concentric circumferential connecting means situated midway between the top ends and the bottom ends, forming a generally oval device. Further, assembly of the device may be achieved in a manner other than described above; for example, instead of starting out by connecting the top of the flexible blades to the common point, the bottom of the flexible blades may be first connected to the concentric circumferential connecting means followed by the connection of the top of the flexible blades to the common point.

What is claimed:

1. A wind operated device, comprising:

a plurality of flexible blade members for catching wind currents, each of said flexible blade members including a top end and a bottom end, each of said blade members having a junction hole proximate to said top end and an inner ring hole and an outer ring hole proximate to the inner edge and outer edge, respectively, of said bottom end;

first connection means connecting said top ends of each of said flexible blade members to each other through said junction holes at a common point;

a pair of concentric circumferential connecting means connecting said bottom ends of each of said flexible blade members in a sequential, equally spaced relationship to each other, each of said concentric circumferential connecting means comprising a semi-rigid connecting ring and spacer divider sections equal in number to the number of flexible blade members, one of said concentric circumferential connecting means having a greater circumference than the other, the larger of said semi-rigid connecting rings passing sequentially through each of said outer holes in the bottom edge of said flexible blade members and the smaller of said semi-rigid connecting rings passing sequentially through each of said inner holes in the bottom edge of said flexible blade members, with a spacer divider section between each pair of flexible blade members on each semi-rigid connecting ring.

2. A wind operated device as set forth in claim 1 wherein the number of flexible blade members is 8.

3. A wind operated device as set forth in claim 1 wherein the distance between the outer and inner semi-rigid connecting means is approximately equal to the distance between the outer ring hole and the inner ring hole in the bottom end of said flexible blade members.

4. A wind operated device as set forth in claim 2 wherein the distance between the outer and inner semi-rigid connecting means is approximately equal to the distance between the outer ring hole and the inner ring hole in the bottom end of said flexible blade members.

* * * * *